United States Patent [19]

Nieman

[11] B 3,991,810

[45] Nov. 16, 1976

[54] METHOD AND APPARATUS FOR INTRODUCING ADDITIVES INTO A CASTING MOLD

[75] Inventor: John R. Nieman, Pekin, Ill.

[73] Assignee: Caterpillar Tractor Co., Peoria, Ill.

[22] Filed: July 15, 1974

[21] Appl. No.: 488,756

[44] Published under the second Trial Voluntary Protest Program on March 16, 1976 as document No. B 488,756.

[52] U.S. Cl. ..... 164/57; 164/270; 164/363

[51] Int. Cl.[2] ..... B22D 27/20

[58] Field of Search ..... 164/55, 56, 57, 270, 164/363

[56] References Cited

UNITED STATES PATENTS

| | | | |
|---|---|---|---|
| 1,596,888 | 8/1926 | Pacz | 164/56 X |
| 2,854,716 | 10/1958 | Funk et al. | 164/57 |
| 2,882,571 | 4/1959 | Easton | 164/56 |
| 3,746,078 | 7/1973 | Moore et al. | 164/55 X |
| 3,766,961 | 10/1973 | Bunting et al. | 164/57 UX |
| 3,851,700 | 12/1974 | McAfee et al. | 164/57 |

*Primary Examiner*—J. Howard Flint, Jr.
*Assistant Examiner*—John E. Roethel
*Attorney, Agent, or Firm*—John W. Grant; Robert E. Muir

[57] ABSTRACT

An apparatus for introducing additives into a casting mold having a flow path for directing a stream of molten metal into a casting cavity formed within the casting mold, and a mixing chamber in the flow path being in registry with a substantially endless wire of additive material continuously fed into the mixing chamber for erodibly substantially completely mixing with the molten metal flowing through the mixing chamber prior to its entry into the casting cavity.

7 Claims, 3 Drawing Figures

17
14
16
13
18
19
12
23
21
24
22
26
27
29
28
10
54
53
52
38
11
48
49
37
56
32
47
44
40
34
41
43
46
33
42
31
39
15

METHOD AND APPARATUS FOR INTRODUCING ADDITIVES INTO A CASTING MOLD

BACKGROUND OF THE INVENTION

A recent development for the in-mold addition of treating agents within the molten metal for castings is disclosed in a co-pending U.S. Patent Application Ser. No. 488,758, filed July 15, 1974 by John R. Nieman et al and entitled METHOD AND APPARATUS FOR THE INTRODUCTION OF ADDITIVES INTO A CASTING MOLD concurrently filed herewith by the Assignee of the present application. The co-pending application teaches continuously feeding a wire of additive material into a stream of molten metal by extending the wire directly into the pouring basin and down sprue within the casting mold. The down sprue acts as an orifice for controlling the flow rate of the molten metal into the casting cavity and the feed rate of the wire is selectively adjusted to provide precise control over the amount of treating agents added to the casting. Although such method is a significant improvement over currently available in-mold methods of adding treating agents, it is recognized that further improvement could be obtained by forming an additional mixing chamber within the casting mold specifically for the purpose of simultaneously receiving the wire of additive material and the flow of molten metal to insure a more uniform dissolution of the treating agents into the molten metal.

OBJECTS OF THE INVENTION

Accordingly, an object of this invention is to provide an improved method and apparatus for introducing additives into a casting mold.

Another object of this invention is to provide such an improved method and apparatus which provides more complete homogeneous mixing of the additives within the casting than heretofore obtainable.

Other objects and advantages of the present invention will become more readily apparent upon reference to the accompanying drawing and following description.

DESCRIPTION OF THE PREFERRED EMBODIMENT

Figure 1:
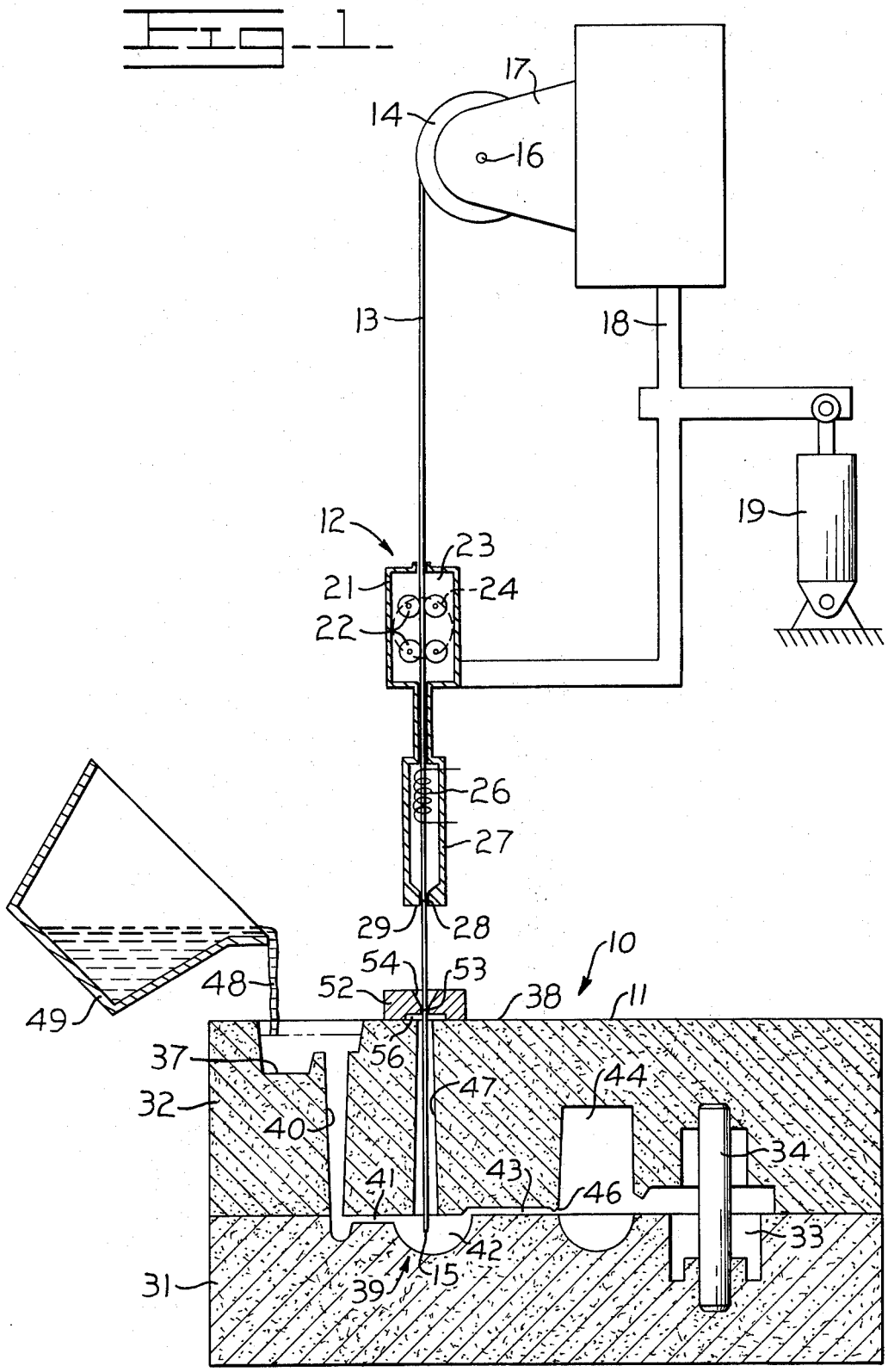
FIG. 1 is a side elevational view of an apparatus for introducing additives into a casting mold embodying the principles of the present invention with portions of the casting mold shown in section for illustrative convenience.

Referring more particularly to the drawings, an apparatus for introducing additives into a casting mold is generally indicated by the reference numeral 10 in association with a casting mold 11 and a wire feed mechanism 12. The additives utilized in the present invention are in the form of a wire 13 which is carried on a reel or spool 14 with the wire having an end 15 extending into the casting mold. The construction of the wire forms no part of the present invention and may be provided in any of the currently available forms such as a solid wire composed entirely of the additive material, a solid wire of additive material within a sheath of protective material, or a hollow core wire filled with powdered additive material. The spool is rotatably supported on a shaft 16 extending between a pair of spaced support plates, one of which is shown at 17. The plates are secured to a frame structure 18 which is raised and lowered by a hydraulic jack 19. A wire feeder 21 is disposed elevationally below the reel and includes a plurality of drive rollers 22 rotatably mounted within a housing 23 secured to the frame structure. The drive rollers are driven in unison by a variable speed reversible motor 24 through a gear train, not shown, in the usual manner. The rollers are provided in substantially opposing pairs which direct the wire downwardly through an open centered heating element 26 of a heater 27 supported below the wire feeder 21. The wire exits through a guide aperture 28 formed in a lower end 29 of the heater.

The casting mold 11 includes a drag 31 and a mating cope 32 separatably fastened together in congruently stacked relation to define an internal casting cavity 33 having a vertically disposed core 34 disposed therein. An open pouring basin 37 is formed in an upper surface 38 of the cope and forms part of a flow path 39 in fluid communication with the casting cavity. A down sprue 40 connects the pouring basin with a reaction or mixing chamber 42, the shape of which will be hereinafter described in greater detail. A choke 43 connects the mixing chamber with a riser 44 through an ingate 46 with the riser in turn being connected to the casting cavity. A passage 47 is formed in the cope substantially parallel to the down sprue and connects the mixing chamber with the upper surface. The casting mold is positioned with the passage 47 in axially aligned relation with the aperture 28 so that the wire 13 is extended substantially concentrically into the passage. The pouring basin is positioned to receive a stream of molten metal 48 from a ladle 49.

A wire entry guide block 52 is removably positioned upon the upper surface 38 of the cope 32 and has a passage 53 extending therethrough in alignment with the passage 47 in the cope. The passage 53 is provided with a conical guide 54 at its upper end. A relief 56 is formed in the bottom of the guide block. The guide block is preferrably constructed from cast iron or other heavy metal so that it remains stationary due to its own weight after being positioned on the upper surface of the cope.

Figure 2:
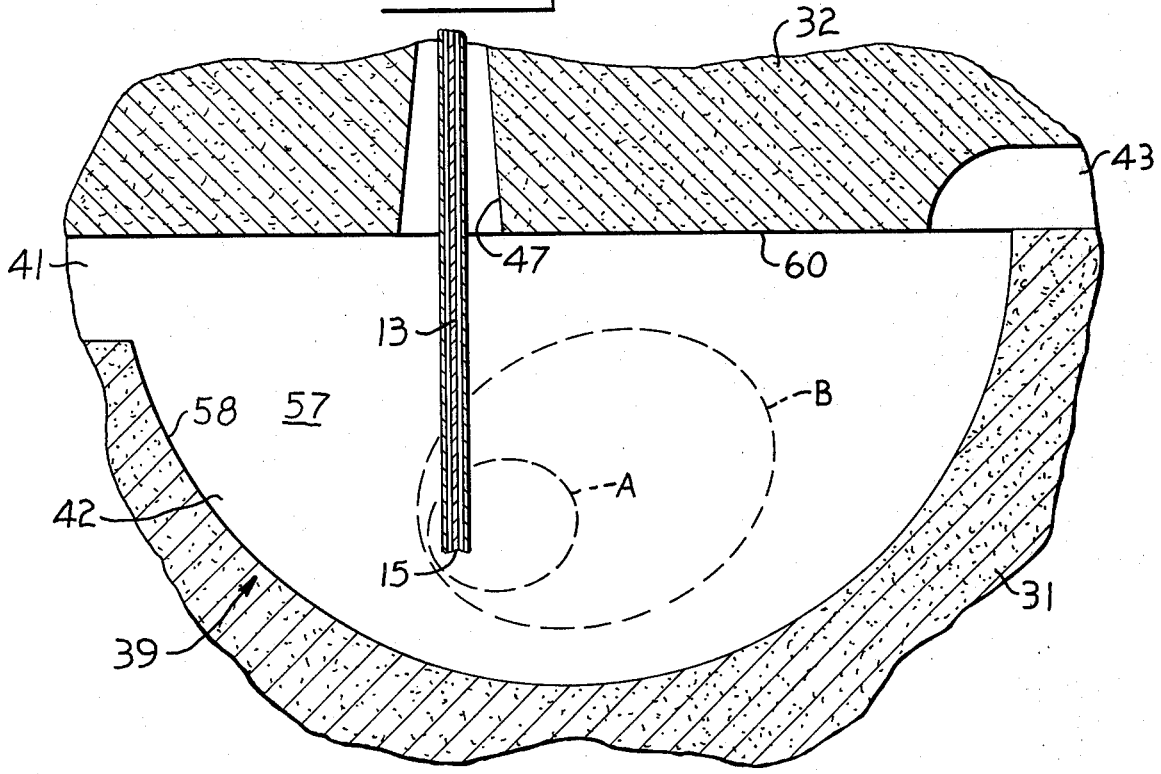
FIG. 2 is an enlarged sectional view of a portion of the casting mold.
Figure 3:
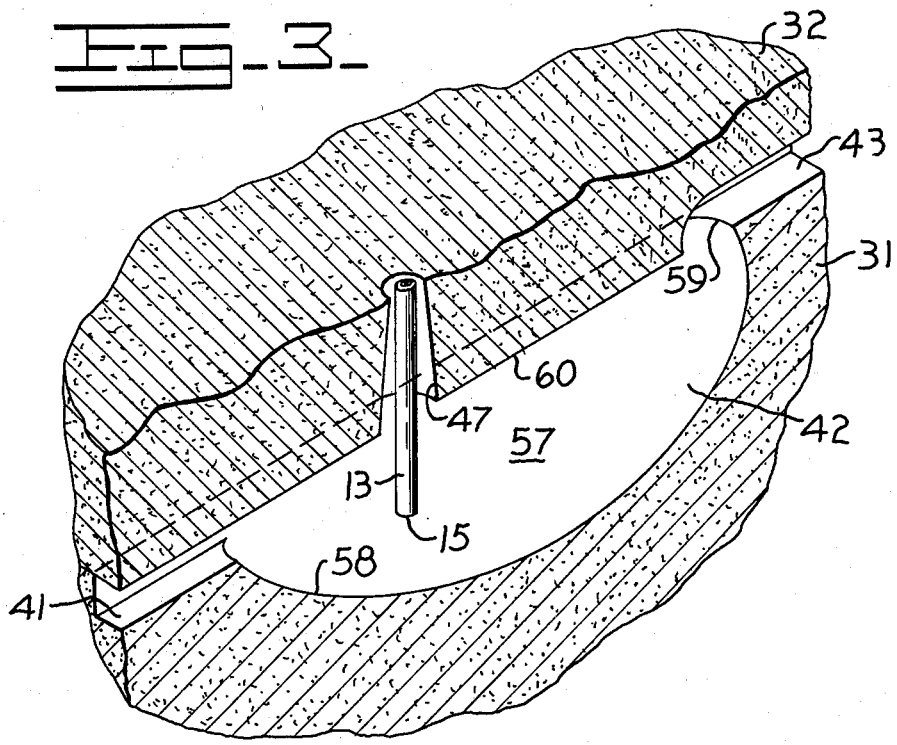
FIG. 3 is an isometric view of FIG. 2.

As more clearly shown in FIGS. 2 and 3 the mixing chamber 42 is formed in the drag 31 of the casting mold 11 and has an elongated semi-circular configuration. The mixing chamber is defined by a pair of spaced vertical sidewalls one of which is shown at 57 which have their lower edges interconnected to a semi-circular floor 58 having an arcuate cross section as shown at 59 in FIG. 3. A flat surface 60 formed on the cope 32 forms the top wall or upper boundary of the mixing chamber. The runner 41 is formed in the drag and is elevationally lower than the choke 43 which is formed in the cope. Furthermore, the cross sectional area of the runner is slightly larger than the cross sectional area of the choke to assure complete filling of the mixing chamber, stabilize the level of the molten metal entering the passage 47 and maintain a positive head pressure on the molten material within the mixing chamber.

OPERATION

While the operation of the present invention is believed clearly apparent from the foregoing description, further amplification will subsequently be made in the following brief summary of such operation. The apparatus 10 is utilized in a method of introducing additives in wire form into the casting mold 11 and includes the steps of pouring molten metal 48 from the ladle 49 into the pouring basin 37 at a predetermined controlled rate. The molten metal flows through the down sprue 40 and runner 41 into the mixing chamber 42. The hydraulic jack 19 is actuated simultaneously with the pouring of the molten metal into the pouring basin so that the lower end 15 of the wire passes through the passage 53 in the guide block 52, the passage 47 in the cope 32, and extends into the molten metal within the mixing chamber. The variable speed motor 24 of the wire feeder 21 is actuated to continue the feeding of the wire when the hydraulic jack 19 bottoms. The form of the wire is selected so that its end is melted or eroded at a substantially predetermined uniform rate within the mixing chamber and the feed rate of the wire feeder is conveniently adjusted to match the melting rate.

As the wire 13 melts or goes into solution with the molten metal 48 within the mixing chamber 42, the temperature of the molten metal is depressed slightly in a zone surrounding the end of the wire with such zone being enclosed by the dashed line indicated by the letter A in FIG. 2. The depressed temperature in zone A increases the recovery and therefore the effectiveness of the additive material of which the wire is composed. The flow of the molten metal in the mixing chamber disperses the additives which begin to boil or vaporize causing turbulence and mixing within a zone as depicted by the dashed line indicated by the letter B. The temperature of the molten metal and additive mix starts to recover in zone B. Some types of wire may be coated with a nodularization and/or deoxidation additives in the form of a temperature depressant material and these additives also go into solution at the outer fringes of zone B with the temperature of the molten metal continuing to recover as the additives become thoroughly mixed within the molten metal.

The semi-circular configuration of the mixing chamber causes the mean velocity of the molten metal to decrease in the area of the wire to increase the dissolution of the wire in the molten metal with the velocity increasing as it exits from the reaction chamber through the runner providing increased mixing action of the additive and the molten metal. Furthermore, the rounded contour of the chamber eliminates any sharp corners and stagnant zones which could trap portions of the molten stream.

As the treated molten metal exits from the mixing chamber 42 through the choke 43 and ingate 46, it flows into the riser 44 and subsequently into the casting cavity 33. The oxides, sulfides and other impurities segregate to the surface and float along in a thin surface strata in the mixing chamber and choke with the ingate and riser being positioned to promote the entrapment of the impurities in the riser.

The flow of molten metal from the pouring basin 37 through the flow path 39 and into the casting cavity 33 continues until the cavity is filled. At this time the stream of molten metal 48 from the ladle 49 is stopped, the wire feeder 21 is deactuated, and the hydraulic jack 19 is actuated to raise the frame structure 18 and thus the end 15 of the wire from the mixing chamber 42 and passage 47.

In some instances wherein the composition of the wire 13 and/or the temperature of the molten metal 48 in the ladle 49 require, the heater 27 is energized to preheat the wire to a preselected temperature as it passes therethrough to increase the dissolution rate of the wire. In such instances, the motor 24 is reversed to withdraw the wire from the heater and into the wire feeder 21 prior to starting the pour. The heater is then energized and the motor actuated in a forward direction to feed the wire through the heater in sequence with the start of the pour so that the end of the wire enters the mixing chamber in sequence with the filling of the chamber with the molten metal.

In view of the foregoing, it is readily apparent that the structure of the present invention provides an improved apparatus for introducing additives into a casting mold which provides more complete homogeneous mixing of the additives introduced into the molten metal than heretofore possible. The mixing chamber forms a relatively narrow, elongated, semi-circular trough through which all of the molten materials entering the casting cavity must pass with the shape of the chamber promoting the complete mixing of the additive into the molten metal.

While the invention has been described and shown with particular reference to the preferred embodiment it will be apparent that variations might be possible that would fall within the scope of the present invention which is not intended to be limited except as defined in the following claims.

What is claimed is:

1. A method of introducing additives into a casting mold having a casting cavity therein, including the steps of:

forming the casting mold with a down sprue, a mixing chamber, a runner connecting the down sprue with the mixing chamber, a choke at a level above the runner and of smaller cross section than the runner, a riser connected between the choke and the casting cavity, and an ingate disposed between the choke and the riser;

flowing molten metal into a pouring basin formed in the casting mold and connected to the down sprue;

directing the flow of molten metal from the pouring basin through the mixing chamber to the casting cavity;

positioning a wire feeder above the casting mold and in line with an open passage formed in the mold extending upwardly from the mixing chamber;

continuously feeding a substantially endless wire of additive material downwardly through the open passage and into the mixing chamber;

erodibly substantially completely mixing the wire of additive material into the molten metal flowing through the mixing chamber prior to its entry into the casting cavity; and segregating impurities from the molten metal and collecting such impurities in the riser.

2. The method as set forth in claim 1 including the step of controlling the pouring of the molten metal into the pouring basin at a predetermined rate.

3. The method as set forth in claim 2 including the step of adjusting the feed rate of the wire feeder.

4. An apparatus for introducing additives into a casting mold, comprising;

a casting mold having an internal casting cavity and a flow path within the mold for directing molten metal into said casting cavity;

means forming a pouring basin in the mold for receiving and introducing a flow of molten metal into said flow path;

means forming a mixing chamber in said flow path of said casting mold intermediate the pouring basin and said casting cavity;

means forming an open ended passage in said casting mold in communication with said mixing chamber;

a wire feeder disposed externally of the mold for continuously feeding a substantially endless wire of additive material through said passage and into said mixing chamber so that said wire is erodibly substantially completely mixed with the molten metal flowing through said mixing chamber toward said casting cavity; and said flow path including a down sprue in the mold extending downwardly from the pouring basin, a runner connecting the down sprue with the mixing chamber, a choke connecting the mixing chamber with said casting cavity and disposed at a level above the runner and having a smaller cross section than the runner to assure complete filling of the mixing chamber with molten metal prior to the molten metal flowing through the choke, a riser connected between the choke and the casting cavity, and an ingate disposed between the choke and riser with the ingate and riser promoting the segregation of impurities from the molten metal with such impurities being collected in the riser.

5. The apparatus for introducing additives into the casting mold of claim 4 wherein said mixing chamber is constructed in an elongated semi-circular configuration defined by a pair of spaced sidewalls, an arcuate bottom wall interconnecting said sidewalls, and a substantially flat top wall.

6. The apparatus for introducing additives into the casting mold of claim 5 including a wire guide supported by said casting mold and having a guide passage formed therein adapted for alignment with said passage in said casting mold, said wire guide being independent of the wire feeder.

7. The apparatus for introducing additives into the casting mold of claim 4 wherein the wire feeder has a variable speed motor for adjusting the feed rate of the wire into the mixing chamber.

* * * * *